US006579087B1

(12) United States Patent
Vrolijk

(10) Patent No.: US 6,579,087 B1
(45) Date of Patent: Jun. 17, 2003

(54) REGULATING DEVICE FOR GAS BURNERS

(75) Inventor: Enno Vrolijk, Dalen (NL)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/979,789

(22) PCT Filed: May 9, 2000

(86) PCT No.: PCT/EP00/04126

§ 371 (c)(1),
(2), (4) Date: Apr. 3, 2002

(87) PCT Pub. No.: WO00/70267

PCT Pub. Date: Nov. 23, 2000

(30) Foreign Application Priority Data

May 14, 1999 (DE) ..... 199 22 226

(51) Int. Cl.[7] ..... F23N 1/02
(52) U.S. Cl. ..... 431/12; 431/89; 431/90
(58) Field of Search ..... 431/89, 90, 12, 431/20, 76, 80; 236/15 BD, 15 BB, 15 E

(56) References Cited

U.S. PATENT DOCUMENTS 4,468,192 A * 8/1984 Jaeger ..... 431/20
4,645,450 A * 2/1987 West ..... 431/12
5,329,955 A * 7/1994 Gensler et al. ..... 431/90
5,401,162 A * 3/1995 Boone ..... 431/12
5,520,533 A * 5/1996 Vrolijk ..... 431/90

FOREIGN PATENT DOCUMENTS

JP 60-122818 * 7/1895 ..... 431/90

* cited by examiner

*Primary Examiner*—James C. Yeung
(74) *Attorney, Agent, or Firm*—Kris T. Fredrick

(57) ABSTRACT

The invention relates to a control means for gas burners. Control means for gas burners are used for supplying a gas flow and a combustion air flow to a burner. In this procedure, the gas flow is adjustable in dependence on the combustion air pressure. In the case of known control means, pressure measurement is effected by means of a diaphragm, i.e. pneumatically. This pneumatic pressure measurement restricts the scope of application of known control means.

In the case of the control means according to the invention, there is provided a sensor (16) which generates an electric or electronic signal 19 which is used for adjusting the gas valve 11 (FIG. 1).

24 Claims, 2 Drawing Sheets

REGULATING DEVICE FOR GAS BURNERS

BACKGROUND OF THE INVENTION

This invention relates to a control means for a gas burner system. The control means supplies a gas flow and a combustion air flow to the gas burner. The control means adjusts the gas flow through a gas valve that is dependent on the combustion air pressure.

Control means for gas burners are known in the prior art. In a known control means, a determination of the pressure is found by means of a diaphragm, or pneumatically. See EP 0 390 964 A1. The gas valve, based on this pressure determination, controls the gas flow. There are several disadvantages to the pneumatic way that restrict the application range of known control means. For instance, the hysteresis properties of the diaphragm and the forces acting between the diaphragm and the gas valve restrict the working range. Furthermore, the interaction between the small actuating forces and the operating tolerances of the diaphragm restrict the application range because of disturbing influences, such as temperature variations.

SUMMARY OF THE INVENTION

The present invention is a new kind of control means for a gas burner system. The embodiments described herein present a control means for gas burners that solves the problem of a restricted application range.

DETAILED DESCRIPTION OF THE INVENTION

The present invention is a control means for a gas burner system. A gas stream and a combustion air stream are supplied to a gas burner (not represented).

Figure 1:
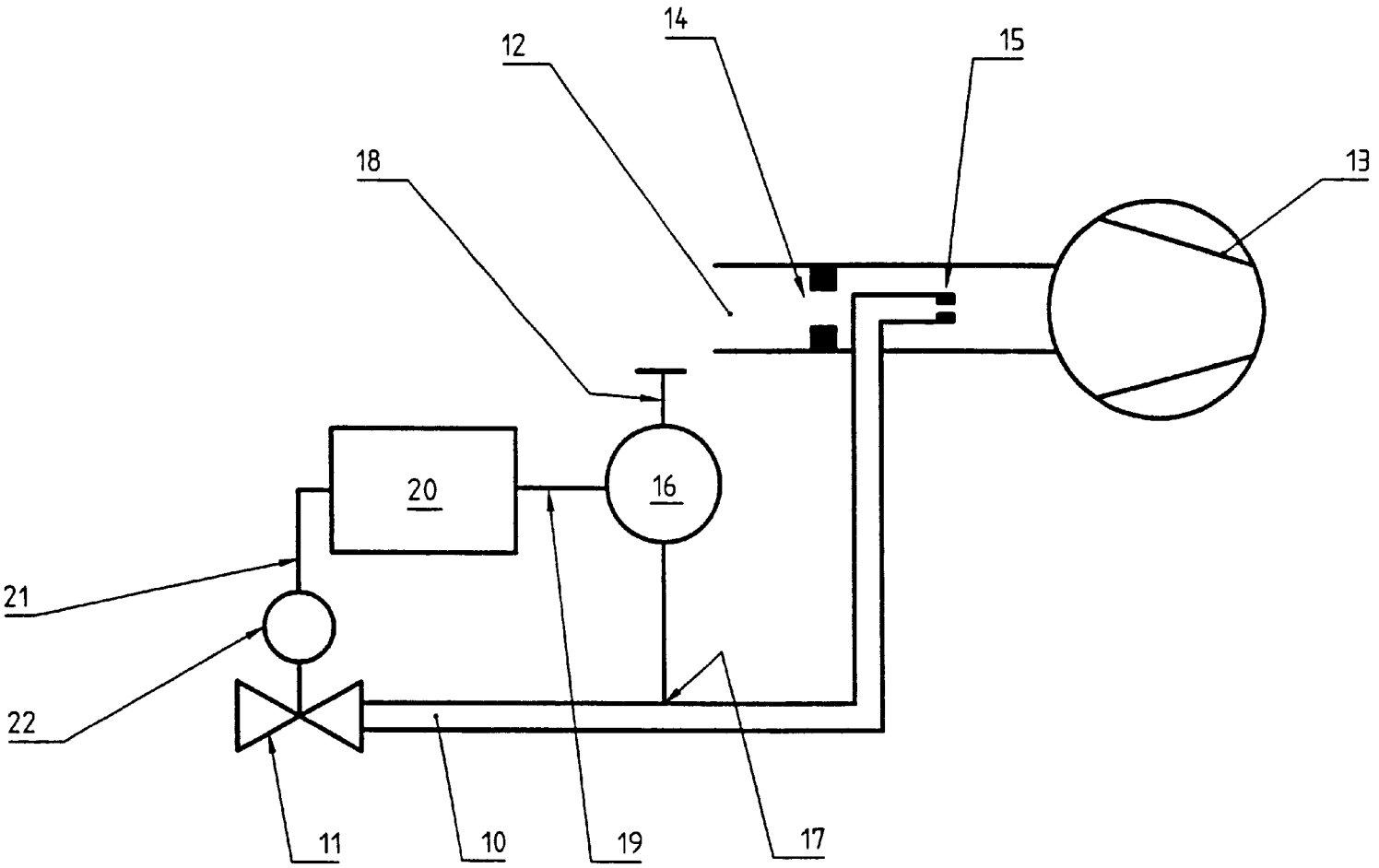
FIG. 1 is a first embodiment of a control means for a gas burner system.

In FIG. 1 a first line 10 supplies the gas stream to the gas burner. The gas stream in the first line 10 flows from a valve 11 to a gas nozzle 15.

A second line 12 supplies the combustion air stream to the gas burner. The combustion air in the second line 12 flows from a blower 13. The second line 12 contains a throttle point 14 upstream of the gas nozzle 15 and the blower 13.

The gas nozzle 15 closes the first line 10 in the range of the second line 12. The gas stream in the first line 10 exits from the nozzle 15 into the second line 12. Therefore, a gas/air mixture exists downstream of the gas nozzle 15 in the direction of the combustion air stream.

The embodiment illustrated by FIG. 1 provides a 1:1 gas-air coupled control. An electric or electronic sensor 16 provides the combined 1:1 gas/air mixture regulation. The sensor 16 functions as a differential pressure sensor, of the flow meter or anemometer type.

The sensor 16 is connected to the first line 10 at a measuring point 17. The measuring point 17 is positioned upstream of the gas nozzle 15. The sensor 16, also, has a reference pressure, which is the combustion air pressure. The FIG. 1 embodiment does not require a connection between the sensor 16 and the second line 12, particularly if the sensor 16 and a combustion air stream inlet are inside the same housing.

The FIG. 1 embodiment of the control means provides a 1:1 gas-air coupled control, in which the gas pressure equals the reference pressure. If the sensor 16 is a flowmeter or anemometer, then the flow through the sensor 16 is zero. For example, if the gas pressure decreases compared to the combustion air pressure, the sensor 16 causes the gas stream to flow in the first line 10. The sensor 16 can establish the pressure ratios between the combustion air pressure and the gas pressure based on the rate of flow.

The sensor 16 generates a signal 19 based on the pressure differential that is used for adjusting the gas valve 11. According to FIG. 1, the signal 19 is fed to a control unit 20. The control unit 20 is either open-loop or closed-loop. The control unit 20 provides a control signal 21 to an actuator 22 of the gas valve 11.

Thus, in FIG. 1, if the sensor 16 detects a pressure difference of zero between the reference pressure and the gas pressure, the signal 19 will correspond to a pressure difference of zero, and the gas valve 11 will not adjust the gas flow in the first line 10. However, if the sensor 16 detects a higher reference pressure than the gas pressure, the gas valve 11 will increase the gas flow in the first line 10. This is accomplished by the control unit 20 generating the control signal 21 for the actuator 22 of the gas valve 11, and resetting the signal 19 to correspond to a pressure difference of zero.

Figure 2:
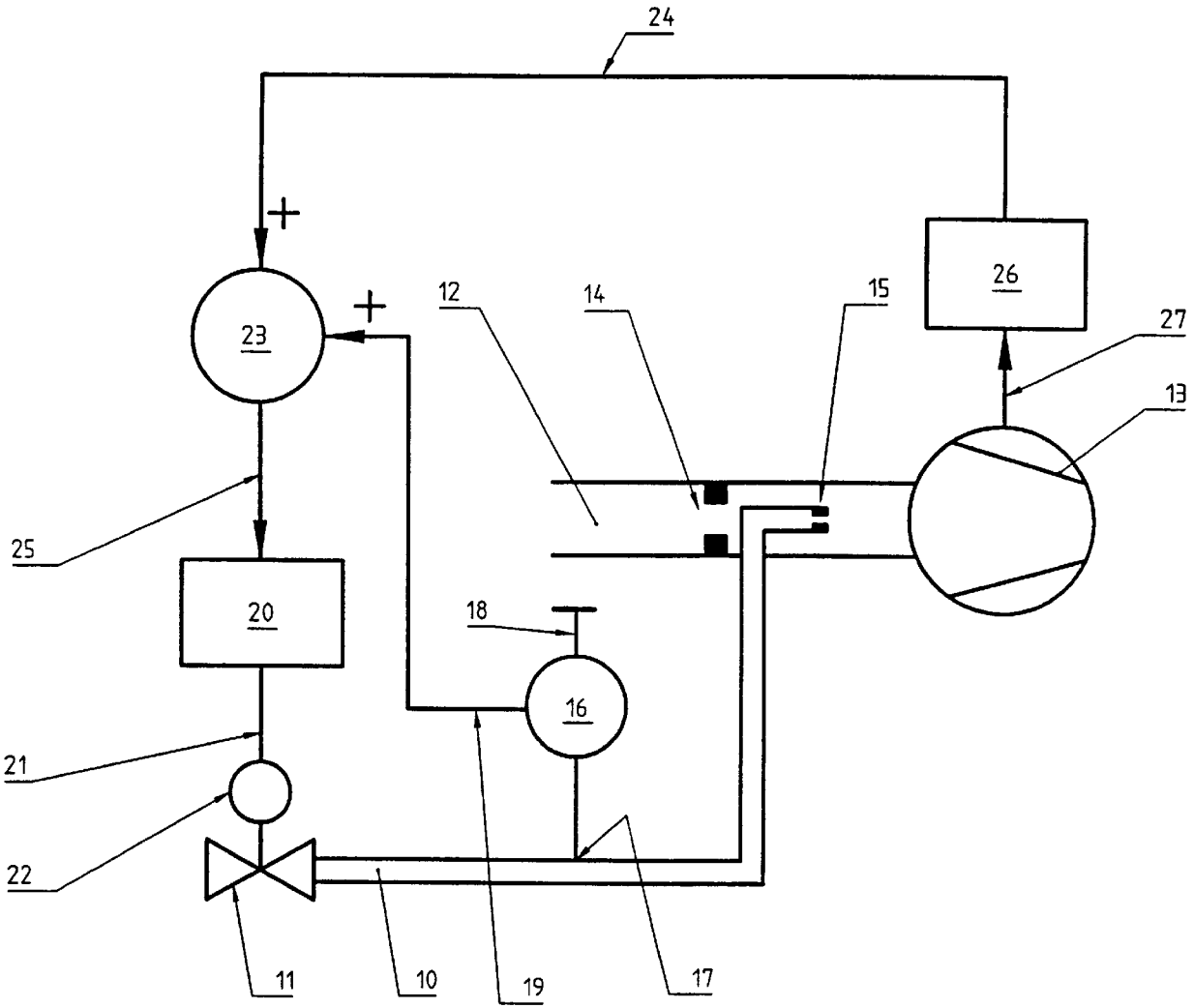
FIG. 2 is a second embodiment of a control means for a gas burner system.

The FIG. 2 embodiment of the control means provides a 1:N gas-air coupled control, so a transformation ratio between the gas flow and the combustion air flow, or the gas pressure and the combustion air pressure, can be obtained.

In FIG. 2, the signal 19 is balanced with an auxiliary signal 24 in a summing means 23 to provide the transformation ratio. The summing means 23 balances the signal 19 with the auxiliary signal 24 before the signal 19 is fed to the control unit 20. The summing means 23 generates an output signal 25. The output signal 25 is supplied to the control unit 20. The output signal 25 is an additive overlay, or superimposition, of the signal 19 and the auxiliary signal 24.

The auxiliary signal 24 is functionally dependent on a rotational speed of the blower 13. An evaluation means 26 generates the auxiliary signal 24 based on a rotational speed signal 27 of the blower 13. Thus, since the auxiliary signal 24 is functionally dependent on the rotational speed of the blower 13, the auxiliary signal 24 is also dependent on the combustion air flow, or the combustion air pressure, respectively.

There are alternatives to the FIG. 2 embodiment for generating the auxiliary signal 24. For example, it is not necessary that the auxiliary signal 24 be dependent on the rotational speed of the blower 13. Rather, an additional sensor (not represented) could generate the auxiliary signal 24. Consequently, gas-adaptive control can be accomplished with the output signal of a smoke gas sensor as the auxiliary signal 24.

The evaluation means 26 can generate a multiplication factor for determining the transformation ratio between the gas flow and the combustion air flow . The transformation ratio can be varied by adjusting the multiplication factor. Thus, the higher the multiplication factor, the higher the transformation ratio.

What is claimed is:

1. A control means for a gas burner system, the gas burner system including a first line through which a gas stream flows from a gas valve to a gas nozzle, and a second line through which a fan forces a combustion air stream, the gas nozzle opening into the second line downstream from a throttle point, the control means comprising, in combination:

a measuring point on the first line, the measuring point positioned upstream from the gas nozzle;

a sensor coupled to the measuring point and to a reference point for providing the sensor with a reference pressure, the sensor generating a signal indicating a pressure differential; and a control unit to provide a control signal to an actuator for controlling the gas valve.

2. The control means of claim 1, wherein the sensor is not directly coupled to the second line.

3. The control means of claim 2, wherein the second line includes an inlet, and wherein the inlet and the sensor are co-located in a housing.

4. The control means of claim 1, wherein an actuator associated with the gas valve receives a control signal generated as a function of the signal from the sensor indicating the pressure differential.

5. The control means of claim 1, wherein the sensor providing a pressure differential is a flow meter.

6. A control means for a gas burner system, the gas burner system including a first line through which a gas stream flows from a gas valve to a gas nozzle, and a second line through which a fan forces a combustion air stream, the gas nozzle opening into the second line downstream from a throttle point, the control means comprising, in combination:

an evaluation means for generating an auxiliary signal, the auxiliary signal based on a detected auxiliary parameter;

a sensor coupled to a measuring point on the first line and providing a signal indicating a differential pressure between the measuring point and a reference point;

a summing means for balancing the signal of the sensor with the auxiliary signal to generate an output signal; and an actuator operative to receive the output signal and to control the gas valve based on the output signal.

7. The control means of claim 6, wherein the sensor is not directly coupled to the second line.

8. The control means of claim 6, wherein the second line includes an inlet, and wherein the inlet and the sensor are co-located in a housing.

9. The control means of claim 6, wherein the auxiliary parameter depends on a rotational speed of the blower.

10. The control means of claim 6, wherein the auxiliary parameter is based on an output signal from a smoke gas sensor.

11. The control means of claim 6, wherein the evaluation means specifies a variable transformation ratio between the gas stream and the combustion air stream.

12. A method for controlling a gas-air mixture to a gas burner system, the gas burner system including a first line through which a gas stream flows from a gas valve to a gas nozzle, and a second line through which a fan forces a combustion air stream, the gas nozzle opening into the second line downstream from a throttle point, comprising in combination:

providing a signal indicating a differential pressure between a first line and a reference point; and controlling an actuating drive based on the signal, thereby controlling the gas valve.

13. The method of claim 12, wherein the differential pressure is measured between a first measuring point positioned upstream from the gas nozzle and a reference point, the reference point providing a reference pressure.

14. The method of claim 12, wherein controlling an actuating drive includes receiving the signal indicating the differential pressure and providing a control signal to the actuating drive.

15. The method of claim 12, wherein the sensor is a flowmeter.

16. The method of claim 12, wherein the sensor is not directly coupled to the second line.

17. The method of claim 16, wherein the second line includes an inlet, and wherein the inlet and the sensor are co-located in a housing.

18. A method for controlling a gas-air mixture to a gas burner system, the gas burner system including a first line through which a gas stream flows from a gas valve to a gas nozzle, and a second line through which a fan forces a combustion air stream, the gas nozzle opening into the second line downstream from a throttle point, comprising in combination:

providing an auxiliary signal based on detecting an auxiliary parameter;

providing a signal indicating a differential pressure between the first line and a reference point;

balancing the auxiliary signal with the signal indicating the differential pressure to provide an output signal; and controlling an actuating drive based on the output signal, thereby controlling the gas valve.

19. The method of claim 18, wherein the auxiliary parameter depends on a rotational speed of the blower.

20. The method of claim 18, wherein the auxiliary parameter is based on an output signal from a smoke gas sensor.

21. The method of claim 18, wherein balancing the auxiliary signal with the signal indicating the differential pressure to provide the output signal allows a gas-air mixture to be set to a variable transformation ratio, wherein a variable transformation ration is specified by an evaluation means, and wherein the evaluation means provides the auxiliary signal.

22. The method of claim 18, wherein the variable transformation ratio is between the gas stream and the combustion air stream.

23. The method of claim 18, wherein the signal indicating the differential pressure is provided by a sensor that is not directly coupled to the second line.

24. The method of claim 23, wherein the second line includes an inlet, and wherein the inlet and the sensor are co-located in a housing.

* * * * *